US007237728B1

(12) United States Patent
Laible

(10) Patent No.: US 7,237,728 B1
(45) Date of Patent: Jul. 3, 2007

(54) HAND-HELD DISPENSER

(76) Inventor: Rodney Laible, P.O. Box 12278, Omaha, NE (US) 68112

( * ) Notice: Subject to any disclaimer, the term of this patent is extended or adjusted under 35 U.S.C. 154(b) by 190 days.

(21) Appl. No.: 11/132,553

(22) Filed: May 19, 2005

(51) Int. Cl.
*A62C 5/02* (2006.01)

(52) U.S. Cl. ..... 239/310; 239/318; 239/347; 239/581.1

(58) Field of Classification Search ..... 239/310, 239/318, 347, 348, 354, 407, 413, 414, 581.1; 222/481, 481.5, 482, 484; 137/268
See application file for complete search history.

(56) References Cited

U.S. PATENT DOCUMENTS 3,034,731 A * 5/1962 Chapin ..... 239/318
3,764,074 A * 10/1973 James ..... 239/318
4,475,689 A * 10/1984 Hauger et al. ..... 239/318
4,901,923 A * 2/1990 McRoskey et al. ..... 239/123
5,039,016 A * 8/1991 Gunzel et al. ..... 239/314
5,100,059 A 3/1992 Englhard et al. ..... 239/310
6,182,911 B1 2/2001 Hanks et al. ..... 239/318
6,378,785 B1 4/2002 Dodd ..... 239/318
6,425,534 B2 * 7/2002 Ketcham et al. ..... 239/316
6,471,141 B2 * 10/2002 Smith et al. ..... 239/10
6,571,824 B2 * 6/2003 Jones et al. ..... 137/597
6,604,546 B1 * 8/2003 Gilmore ..... 137/550
6,726,123 B2 4/2004 Wang ..... 239/310
6,749,133 B1 * 6/2004 Ketcham et al. ..... 239/318
6,772,966 B2 * 8/2004 Foster et al. ..... 239/581.2
6,827,293 B2 * 12/2004 Seeman ..... 239/310
6,869,028 B2 * 3/2005 Bartsch et al. ..... 239/315

* cited by examiner

*Primary Examiner*—Joseph A. Kaufman
*Assistant Examiner*—Trevor McGraw

(57) ABSTRACT

A hand-held dispenser for precisely controlling the flow rate of water therethrough and for precisely controlling the metering of a liquid chemical into the water passing through the apparatus.

1 Claim, 5 Drawing Sheets

HAND-HELD DISPENSER

BACKGROUND OF THE INVENTION

1. Field of the Invention

This invention relates to a hand-held dispenser and more particularly to a hand-held dispenser which is capable of controlling the flow rate of water therethrough and for controlling the metering of a liquid chemical into the water passing through the dispenser.

2. Description of the Related Art

Many types of dispensers have been previously provided which may be connected to the end of a water hose or the like wherein the device introduces chemicals into the water flow so that a lawn or the like may be sprayed. The devices of the prior art are also able to inject liquid chemicals into a water stream so that a mop bucket, etc., may be filled with water, detergent or other chemicals.

To applicant's knowledge, none of the prior art devices are able to conveniently and economically not only precisely control the rate of water flow through the device but to also precisely control the metering of liquid chemicals into the precisely controlled flow of water.

SUMMARY OF THE INVENTION

A hand-held dispenser is described for precisely controlling the flow rate of water therethrough and for precisely controlling the metering of a liquid chemical into the water passing through the apparatus. The apparatus of this invention comprises a body member which includes a generally horizontally disposed first body portion having opposite sides, an inlet end, a discharge end, and a first fluid passageway extending between the inlet and discharge ends. The first body portion has a transversely extending spool opening formed thereon which extends between the opposite sides thereof and which communicates with the first fluid passageway. The inlet end of the first body portion is adapted to be secured to a source of water under pressure.

The body member also includes a generally vertically extending second body portion having upper and lower ends with a second fluid passageway, having upper and lower ends, extending therethrough. The upper end of the second fluid passageway is in communication with the spool opening. The lower end of the second fluid passageway is in communication with a source of liquid chemical.

The first body portion includes an on-off valve in the first fluid passageway upstream of the spool opening. An elongated spool member is selectively slidably movably mounted in the spool opening and is selectively slidably movable between at least first and second positions relative to the first body portion. The spool member has an upstream side, a downstream side, an upper end, a lower end and opposite sides. The spool member has at least first and second horizontally spaced-apart and horizontally disposed water flow passageways formed therein which extend between the upstream side and the downstream side thereof. The spool member also has at least first and second horizontally spaced-apart and vertically disposed chemical flow passageways formed therein which extend from the lower end thereof to the first and second water flow passageways, respectively.

The first and second water flow passageways have different diameters and the first and second chemical flow passageways have different diameters. The first water flow passageway and the first chemical flow passageway are in communication with the first fluid passageway when the spool member is in its first position. The second water flow passageway and the second chemical flow passageway are in communication with the first fluid passageway when the spool member is in its second position. The first chemical flow passageway is in communication with the second fluid passageway when the spool member is in its first position. The second chemical flow passageway is in communication with the second fluid passageway when the spool member is in its second position.

The water flow passageways and the chemical flow passageways are formed in the spool member so that the water flow through the dispenser and the chemical flow into the water may be precisely controlled and selectively varied.

It is therefore a principal object of the invention to provide an improved chemical dispenser.

Still another object of the invention is to provide an improved hand-held dispenser which dispenses chemicals mixed with water.

Yet another object of the invention is to provide a dispenser of the type described which enables the precise controlling of the flow rate of water therethrough and the precise metering of a liquid chemical into the water passing through the dispenser.

Still another object of the invention is to provide a hand-held dispenser which is either disposable or reusable.

Still another object of the invention is to provide a dispenser which is economical of manufacture, durable in use and refined in appearance.

These and other objects will be obvious to those skilled in the art.

DETAILED DESCRIPTION OF THE INVENTION

Figure 1:
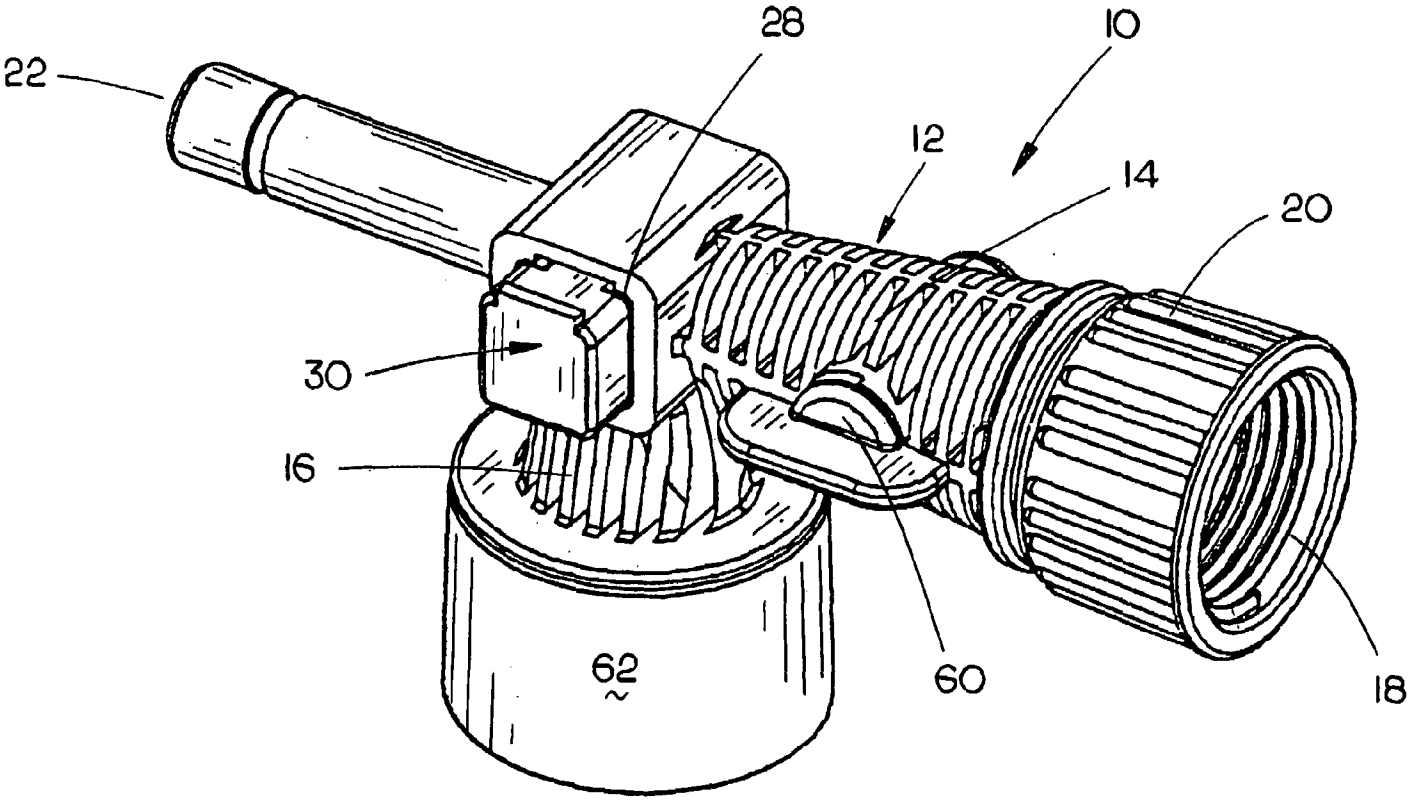
FIG. 1 is perspective view of the dispenser of this invention.
Figure 2:
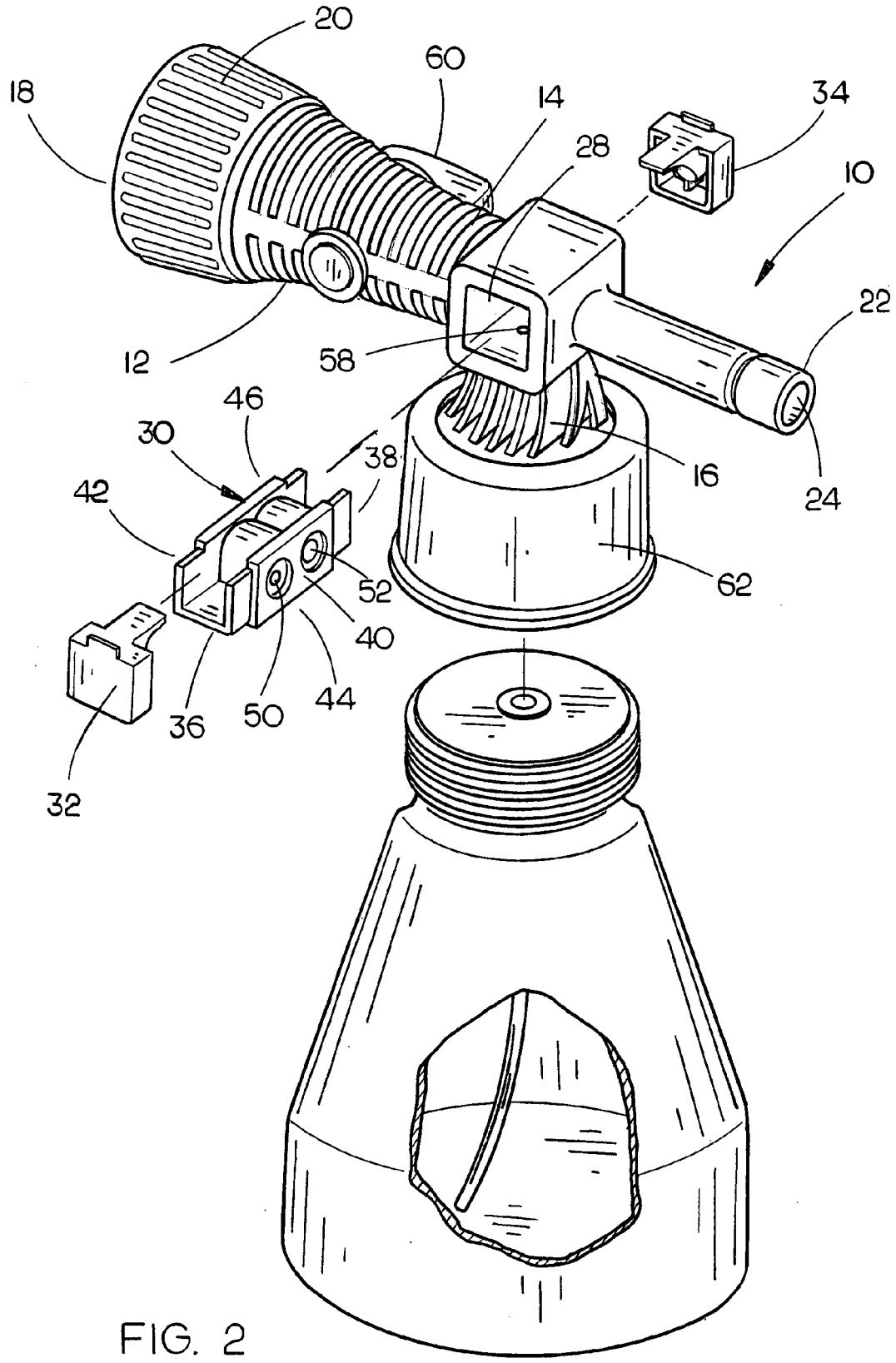
FIG. 2 is an exploded perspective view of the dispenser of this invention.
Figure 3:
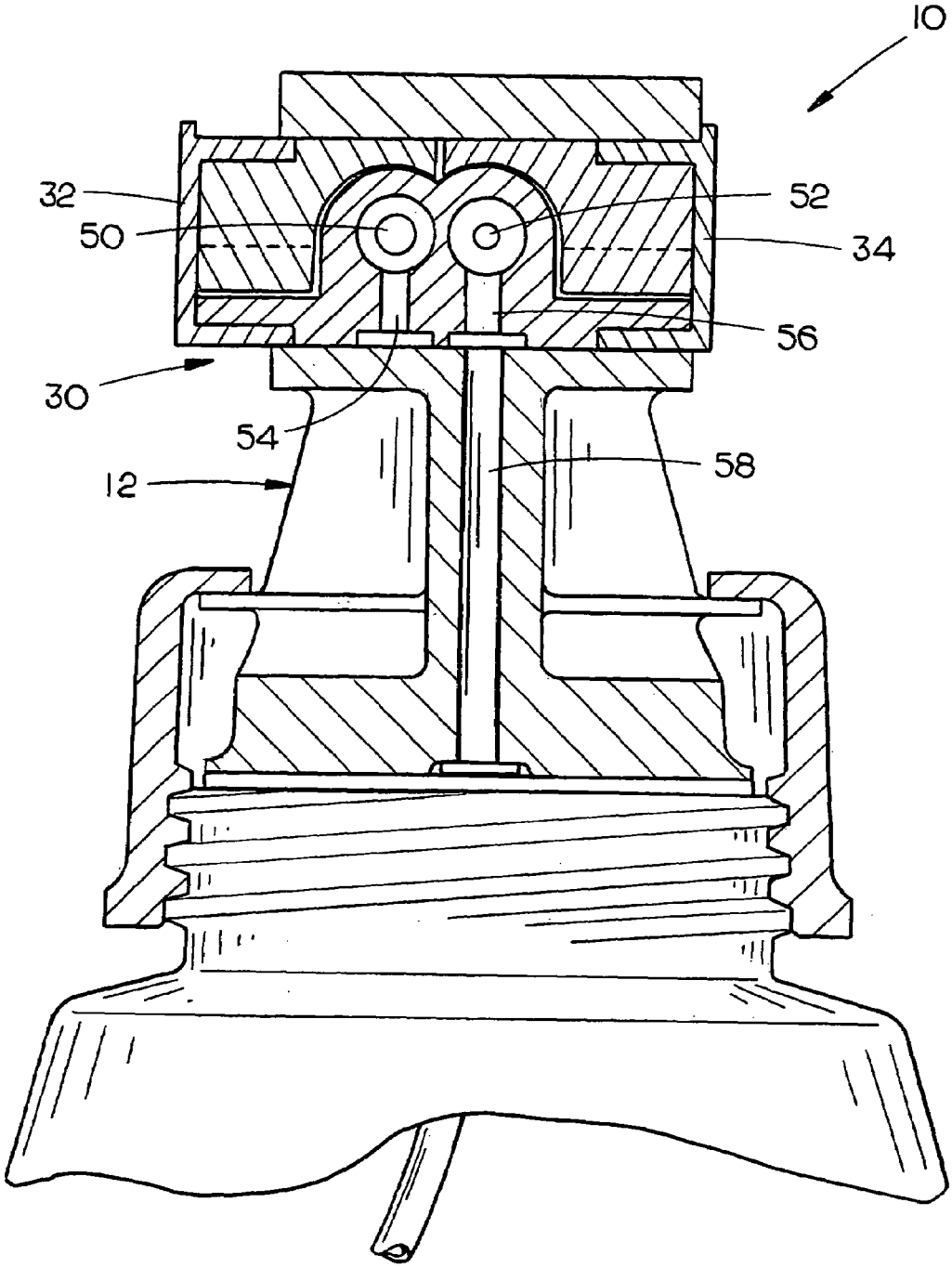
FIG. 3 is a vertical sectional view of the dispenser.
Figure 4:
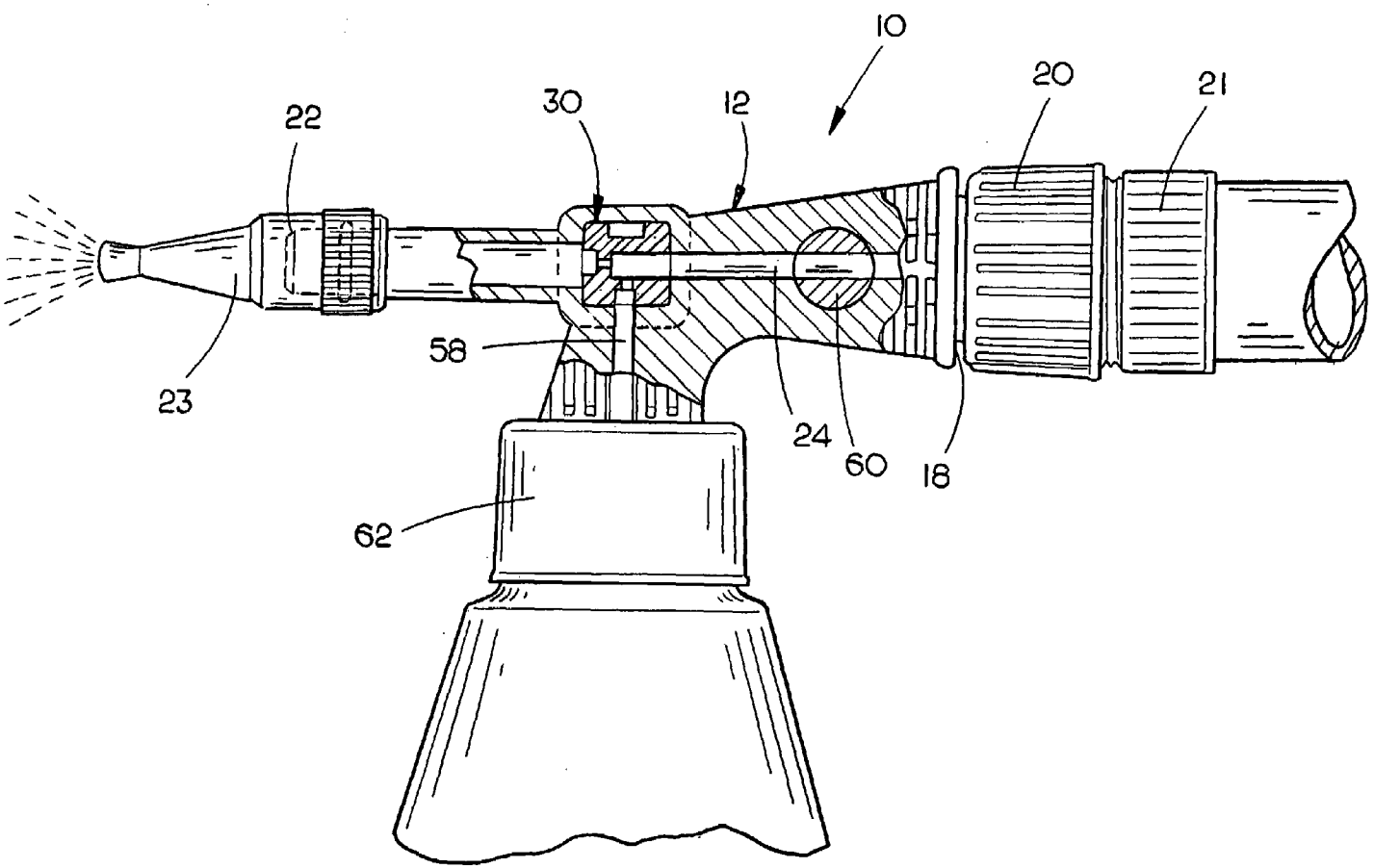
FIG. 4 is a partial sectional view of the dispenser.
Figure 5:
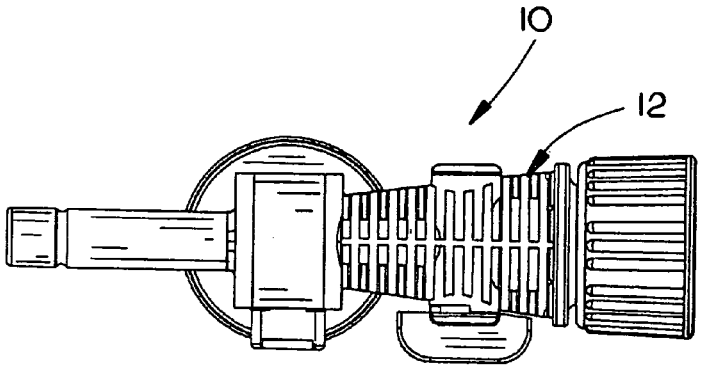
FIG. 5 is a top view of the dispenser.
Figure 6:
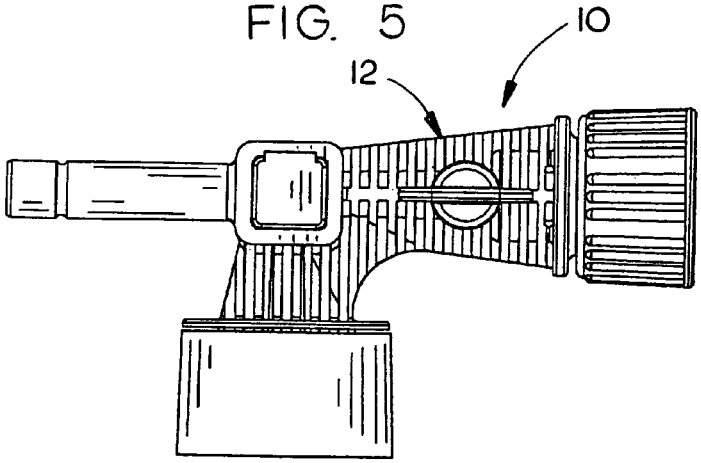
FIG. 6 is a side view of the dispenser.
Figure 7:
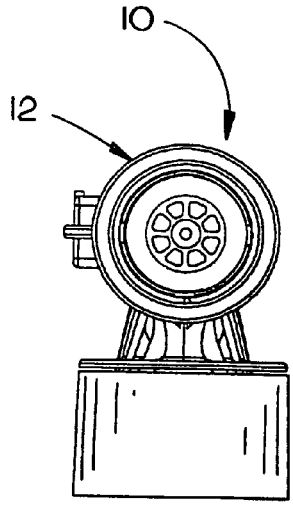
FIG. 7 is an end view of the dispenser as seen from the right of FIG. 6.
Figure 8:
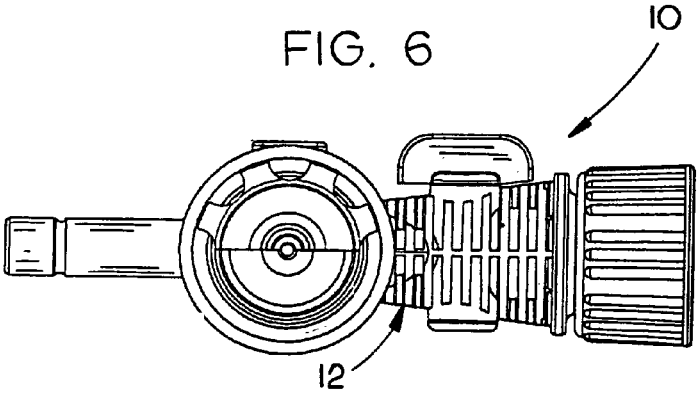
FIG. 8 is a bottom view of the dispenser.

The dispenser of this invention is referred to generally by the reference numeral 10 and is preferably of the hand-held type. Dispenser 10 includes a dispenser body 12 which is generally T-shaped in configuration and which includes a generally horizontally disposed body portion 14 and a generally vertically disposed body portion 16. Obviously, body portion 14 will not always be horizontally disposed when being used nor will body portion 16 always be substantially vertically disposed when in use.

Body portion 14 includes an inlet end 18 which preferably has a rotatable dispenser nut or connector 20 mounted thereon so that a water hose or the like may be secured thereto with the water hose being in communication with a source of water under pressure. It is preferred that a backflow preventer 21 of conventional design be imposed between the water hose and the inlet end 18. The outlet or discharge end 22 of the body portion 14 may have any type of spray deflector nozzle 23 or the like mounted thereon, if so desired. Body portion 14 includes a first fluid passageway 24 extending from the inlet end 18 to the discharge end or outlet end 22.

Body portion 14 is provided with a transversely extending spool opening 28 which intersects and which is in communication with the fluid passageway 24. An elongated, preferably rectangular in cross section, spool 30 is slidably mounted in spool opening 28 and is movable between at least first and second positions. Spool 30 is provided with end caps 32 and 34 mounted on the opposite ends thereof which are removably mounted thereon and which limit the movement of the spool 30 with respect to the body portion 14. For purposes of description, spool 30 will be described as having opposite ends 36 and 38, opposite sides 40 and 42, a lower end 44 and an upper end 46.

At least two water flow control passageways 50 and 52 extend between sides 40 and 42 and have different diameters. At least two chemical flow passageways 54 and 56 extend upwardly into spool 30 from the lower end thereof so as to be in fluid communication with the water flow control passageways 50 and 52, respectively. The chemical flow passageways 54 and 56 have different diameters.

When spool 30 is in its first position, water flow control passageway 50 is in fluid communication with the first fluid passageway 24 and the chemical flow passageway 54 will be in fluid communication with water flow control passageway 50. When spool 30 is in its second position, water flow control passageway 52 is in communication with the first fluid passageway 24 and the chemical flow passageway 56 will be in communication with water flow control passageway 52.

The vertically disposed body portion 16 is provided with a second fluid passageway 58 extending therethrough with the upper end thereof being in communication with the spool opening 28. The numeral 60 refers to a rotary on-off valve which extends transversely through the first fluid passageway 24 so that the flow of water therethrough may be controlled.

The numeral 62 refers to a rotating collar mounted on the lower end of body portion 16 so enable the dispenser to be connected to a conventional chemical container.

With a liquid chemical container having liquid chemical therein is secured to the collar 62 and with the dispenser on-off valve 60 in its open position, and with the dispenser spool in its first position, liquid chemical will be drawn upwardly through the second fluid passageway 58 as water passes through first fluid passageway 24. The liquid chemical in second fluid passageway 58 will pass through chemical flow passageway 54, water flow control passageway 50 and into fluid passageway 24. With the spool 30 in its second position, liquid chemical will be drawn upwardly through the fluid passageway 58, through chemical flow passageway 56, through water flow control passageway 52 and into fluid passageway 24. By providing the dispenser spool 30 with the water flow control passageways 50, 52 and the chemical flow passageways 54, 56, the chemical added to the water is precisely metered depending upon the diameters of the chemical flow passageways 54 and 56. The flow of water through the dispenser is precisely controlled through the use of the variable diameter water flow control passageways 50 and 52. Although the dispenser spool 30 is described as having a pair of chemical flow passageways and a pair of water flow control passageways formed therein, the dispenser spool 30 could be provided with additional sets of chemical flow passageways and water flow control passageways with the dispenser spool being selectively movable between a plurality of operating positions.

Thus it can be seen that the invention accomplishes at least all of its stated objectives.

I claim:

1. A hand-held dispenser apparatus for controlling the flow rate of water therethrough and for controlling the metering of a liquid chemical into the water passing through the apparatus, comprising:

a body member;

said body member including a generally horizontally disposed first body portion having opposite sides, an inlet end, a discharge end, and a first fluid passageway extending between said inlet and discharge ends;

said first body portion having a transversely extending spool opening formed therein which extends between said opposite sides thereof and which communicates with said first fluid passageway;

said first fluid passageway including a venturi which is positioned upstream of said spool opening;

said inlet end of said first body portion adapted to be secured to a source of water under pressure;

said body member also including a generally vertically extending second body portion having upper and lower ends with a second fluid passageway, having upper and lower ends, extending therethrough;

said upper end of said second fluid passageway being in communication with said first fluid passageway downstream of said venturi;

said lower end of said second fluid passageway being in communication with a source of liquid chemical;

said first body portion including an on/off valve in said first fluid passageway upstream of said venturi;

an elongated spool member selectively slidably movably mounted in said transversely extending spool opening which is selectively slidably movable between at least first and second positions relative to said first body portion;

said spool member having an upstream side, a downstream side, an upper end and a lower end;

said spool member having at least first and second horizontally spaced-apart and horizontally disposed water flow passageways formed therein which extend between said upstream side and said downstream side;

said spool member having at least first and second horizontally spaced-apart and vertically disposed chemical flow passageways formed therein which extend from its said lower end to said first and second water flow passageways, respectively;

said first and second water flow passageways having different diameters;

said first and second chemical flow passageways having different diameters;

said first water flow passageway and first chemical flow passageway being in communication with said first fluid passageway when said spool member is in its said first position;

said second water flow passageway and said second chemical flow passageway being in communication with said first fluid passageway when said spool member is in its said second position;

said first chemical flow passageway being in communication with said second fluid passageway when said spool member is in its said first position;

said second chemical flow passageway being in communication with said second passageway when said spool member is in its said second position.

* * * * *